US007791856B2

(12) United States Patent
Samila

(10) Patent No.: US 7,791,856 B2
(45) Date of Patent: Sep. 7, 2010

(54) METHOD AND APPARATUS FOR MOVING MATERIAL

(75) Inventor: John Samila, Porter, IN (US)

(73) Assignee: Ephaugh, Inc., Porter, IN (US)

( * ) Notice: Subject to any disclaimer, the term of this patent is extended or adjusted under 35 U.S.C. 154(b) by 746 days.

(21) Appl. No.: 11/766,945

(22) Filed: Jun. 22, 2007

(65) Prior Publication Data

US 2008/0195248 A1 Aug. 14, 2008

Related U.S. Application Data

(60) Provisional application No. 60/900,674, filed on Feb. 9, 2007.

(51) Int. Cl.
*H01H 47/00* (2006.01)

(52) U.S. Cl. ..... 361/144; 361/143; 361/145; 318/141; 318/142; 294/65.5; 414/606; 414/737; 335/289; 335/290

(58) Field of Classification Search ..... 361/143, 361/144, 145; 318/141, 142, 143, 158; 294/65.5; 414/606, 737, 797.1; 335/289, 290, 291, 335/295

See application file for complete search history.

(56) References Cited

U.S. PATENT DOCUMENTS 3,445,105 A * 5/1969 Marcher ..... 271/18.2
3,561,541 A * 2/1971 Woelfel ..... 172/260.5
3,629,663 A * 12/1971 Butkus ..... 361/144
3,708,685 A * 1/1973 Miller et al. ..... 307/104
3,723,825 A * 3/1973 De Viney ..... 361/144
4,323,329 A * 4/1982 Chlad ..... 414/737
4,647,268 A 3/1987 Scholl
5,325,260 A * 6/1994 Repetto ..... 361/144
5,751,126 A 5/1998 Hellinger et al.
5,813,712 A * 9/1998 Mozelt ..... 294/65.5
5,959,416 A * 9/1999 Clutter et al. ..... 318/141
5,998,944 A 12/1999 Clutter et al.

OTHER PUBLICATIONS

U.S. Appl. No. 12/002,527, filed Dec. 17, 2007 entitled Method and Apparatus for Moving Material, 17 pages including drawings.
International Search Report and Written Opinion of PCT/US2008/002882 consisting of 8 pages.

* cited by examiner

*Primary Examiner*—Patrick Salce
(74) *Attorney, Agent, or Firm*—Factor & Lake, Ltd.

(57) ABSTRACT

A method and apparatus for moving magnetic material includes an electromagnet for lifting the magnetic material where upon its release, the residual magnetic flux of the lifted magnetic material is reduced. The apparatus includes a generator coupled to the electromagnet. The generator includes a control input and an armature having a voltage output. A controller has an output coupled to the generator's control input and armature voltage output, whereupon receiving a release material signal from an operator interface panel to release the magnetic material from the electromagnet, the controller transmits a plurality of control signals, one of which is at least partially dependent upon the duration of a previously transmitted control signal, to effectively alternate the polarity and reduce the magnitude of the magnetizing force of the electromagnet.

4 Claims, 3 Drawing Sheets

METHOD AND APPARATUS FOR MOVING MATERIAL

RELATED APPLICATIONS

This application claims the benefit of the filing date of U.S. Provisional Patent Application No. 60/900,674 filed Feb. 9, 2007; the content of which is expressly incorporated herein by reference.

TECHNICAL HELD

The present invention generally relates to the field of lifting devices and more specifically, to a method and apparatus for controlling an electromagnet of a machine for attaching, moving, and releasing magnetic material.

BACKGROUND OF THE INVENTION

The material handling industry utilizes a variety of mechanisms to lift, move, and place materials such as scrap or finished products. For relocating magnetic materials, e.g., diamagnetic metals, paramagnetic metals, and ferromagnetic metals; an electromagnet is preferable in many cases because it does not require personnel to position the chains, hooks, and other mechanical grasping mechanisms often utilized during the attachment and release of the magnetic material. Such grasping mechanisms can further mar metal surfaces and increase the possibility of product damage.

One drawback to using an electromagnetic lifting device is that the magnetic material may not be readily released by the electromagnet when its power source is removed. For instance, when the power source to the electromagnet is removed, the magnetic material will not immediately be released, but will eventually drop due to the force of gravity. As such, it is common to temporarily reverse the polarity of the electromagnet to repel or "push" the magnetic material from the electromagnet. The magnitude of the reverse charge can be significant and as a result, some magnetic materials—e.g., ferromagnetic—may be re-attracted to the now oppositely charged electromagnet and not drop; or if released, will retain an undesired residual magnetism.

The present invention is provided to address these and other issues.

SUMMARY OF THE INVENTION

The present invention is a method and apparatus for moving material. More specifically, a lifting device includes an electromagnet operatively coupled to a voltage generator. A controller is provided with a predetermined reference voltage for dropping the magnetic material. Upon receiving a signal from an operator interface to release lifted material, a control signal to drop, i.e., repel, the magnetic material is transmitted to the voltage generator. The transmission of the drop control signal is terminated in response to the voltage at the output of the generator's armature being substantially equal to the predetermined reference voltage. Subsequently, a signal to lift, i.e., attract, the magnetic material is then transmitted from the controller to the voltage generator, wherein the duration of the drop control signal is utilized to calculate a forward thrust set-point voltage. The transmission of the lift control signal is terminated in response to the voltage at the output of the generator's armature being substantially equal to the calculated forward thrust set-point voltage.

Another aspect of the present invention includes a system for moving magnetic materials wherein an electromagnet is utilized to lift and drop magnetic material and upon the release thereof, the residual magnetic flux of the magnetic material is reduced. The system comprises a generator operatively coupled to an electromagnet. The generator includes a control input and an armature having a voltage output, A controller having an output is operatively coupled to the generator's control input. A voltage monitor or sensor is operatively coupled to the voltage output of the armature, wherein a first control signal (drop)—determined at least partially in response to the voltage output of the armature being substantially equal to a predetermined voltage reference—is transmitted from the controller's output to the generator's control input; and, a second control signal (lift)—determined at least partially in response to the duration of the first control signal—is transmitted from the controller's output to the generator's control input.

A further aspect of the present invention is a system for moving magnetic material comprising a first circuit operatively coupled to a second circuit. The first circuit includes an operator interface, a programmable logic controller a predetermined voltage reference; and a generator field. The second circuit includes a generator armature operatively coupled to an electromagnet, wherein the generator armature includes a voltage output operatively coupled to the programmable logic controller. A plurality of control signals—lift and drop—are transmitted from the programmable logic controller to the generator field to attract and release the magnetic material such that the amount of residual magnetic flux retained by the magnetic material after its release is substantially minimized. The drop control signal is transmitted from the controller to the generator field in response to a release material signal being received from the operator interface. Transmission of the drop control signal terminates when the armature voltage output is substantially equivalent to the predetermined voltage reference. The lift control signal is transmitted from the controller to the generator field after termination of the drop control signal. Transmission of the lift control signal terminates when the magnitude of the armature voltage output is substantially equivalent to a forward thrust set-point voltage, wherein calculation of the forward thrust set-point voltage is at least partially dependent upon the duration of the transmitted drop control signal.

An object of the present invention is to provide a means to facilitate the relocation of material.

A further object of the present invention is to provide a magnetic means to facilitate the relocation of material, whereupon the release of the magnetic materials, substantially all the lifted magnetic material is dropped from the electromagnet.

Another object of the present invention is to utilize an electromagnet to attract, lift, move, place, and release magnetic materials, whereupon the release of the magnetic materials, the extent of residual magnetism retained by the magnetic materials is reduced to a desirable level.

These and other aspects and attributes of the present invention will be discussed with reference to the following drawings and accompanying specification and claims.

DETAILED DESCRIPTION OF THE EMBODIMENT

Figure 2:
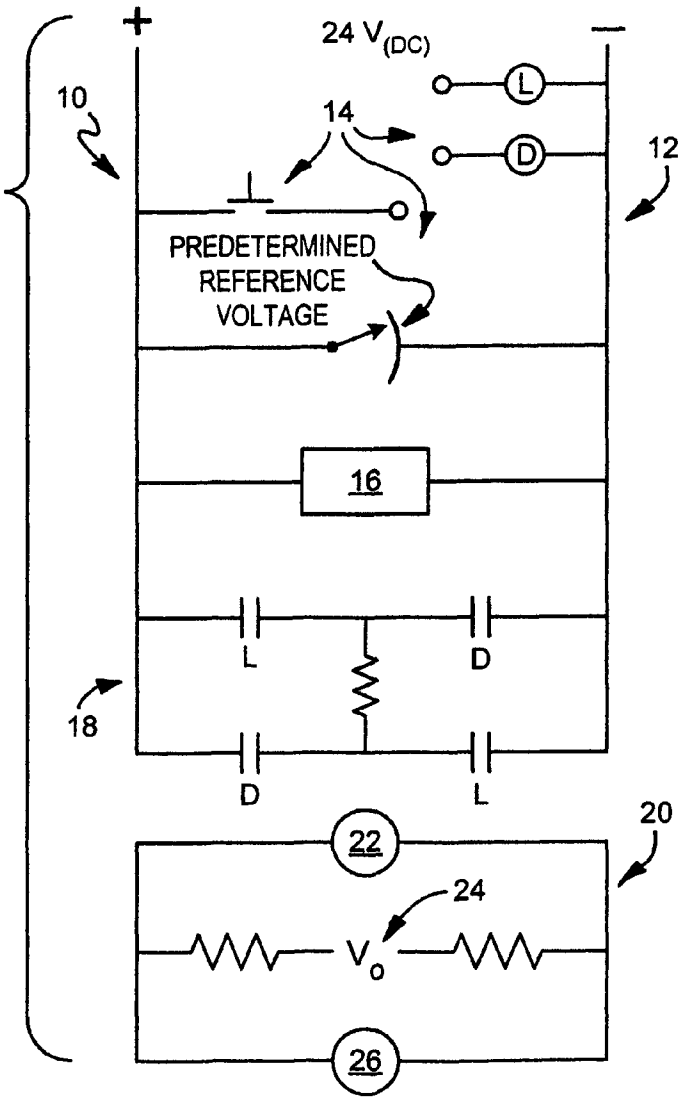
FIG. 2 is a schematic illustration of one embodiment of the present invention.

While the present invention is susceptible of embodiment in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated.

One embodiment of the present invention is directed to a system for moving magnetic material. The magnetic material is attracted to an electromagnet, lifted, moved to another location, and released from the electromagnet. Preferably, upon release of the magnetic material, all the lifted material is dropped from the electromagnet and any extent of residual magnetic flux retained by the dropped magnetic material is reduced to a desirable level.

Figure 1:
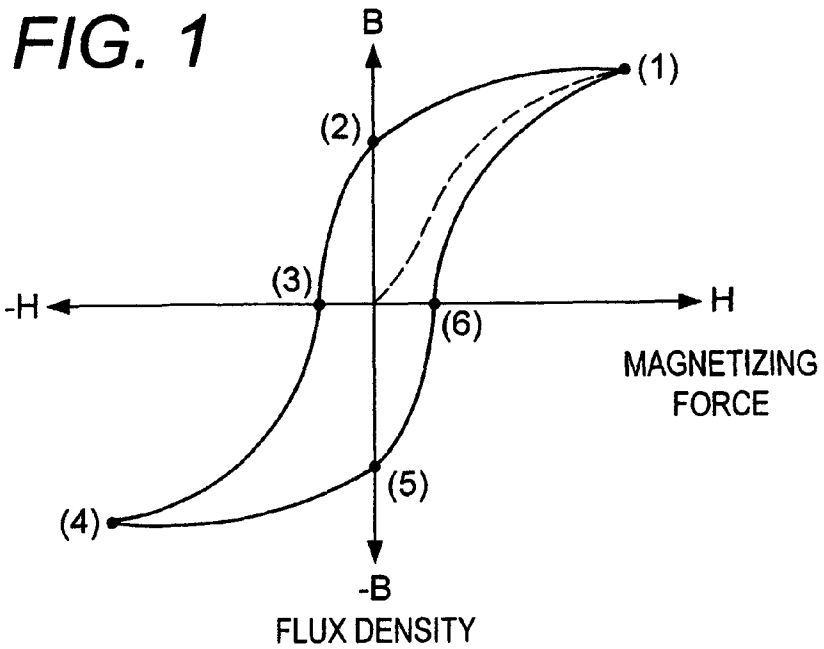
FIG. 1 is a graphic illustration depicting the relationship between an induced magnetic flux density and a magnetizing force.

FIG. 1 is a graphic illustration of an exemplification depicting the known relationship between an induced magnetic flux density (B) and a magnetizing force (H) that occurs during the attraction and repulsion of a magnetic material. A hysteresis loop is generated by measuring the magnetic flux of a magnetic material, e.g., ferromagnetic, while the magnetizing force is changed. Ferromagnetic material that has never been previously magnetized or has been thoroughly demagnetized will follow the dashed line as the magnetizing force is increased. The greater the amount of magnetizing force, the stronger the magnetic field in the component. At point (1), almost all of the magnetic domains are aligned and any additional increase in the magnetizing fore will produce very little increase in magnetic flux. Here, the material has reached the point of magnetic saturation. When the magnetizing force is decreased to zero, the curve will move from point (1) to point (2). At point (2), some magnetic flux remains in the material even though the magnetizing force is zero. This is referred to as the point of retentivity and indicates the level of residual magnetism in the material. That is, some of the magnetic domains remain aligned, but some have lost their alignment. As the magnetizing force is reversed, the curve moves to point (3), where the flux has been reduced to zero. This is known as the point of coercivity, wherein the reversed magnetizing force has flipped enough of the domains such that the net flux within the material is zero.

As the magnetizing force is increased in the negative direction, the material will again become magnetically saturated but in the opposite direction, point (4). Reducing the magnitude of the magnetizing force to zero brings the curve to point (5), and further increasing the magnitude of the magnetizing force in the positive direction will return the flux density to zero, point (6). The curves does not return to its origin because some force is required to remove the residual magnetism and the curve will take a different path from point (6) to the saturation point of point (1).

From the representative hysteresis loop shown in FIG. 1, several magnetic properties of a material can be determined: (a) retentivity is a material's ability to retain a certain level of residual magnetic field when the magnetizing force is removed after achieving saturation, i.e., the amount of flux density at point (2); (b) residual magnetism or residual flux is the magnetic flux density that remains in a material when the magnetizing force is zero; and, (3) coercive force is the amount of reverse magnetic field that must be applied to a magnetic material to make the magnetic flux return to zero, i.e., the amount of magnetizing force at point (3).

Referring now to FIG. 2, a preferred embodiment of the present invention is depicted and includes a first circuit 12—regulation circuit—that includes an operator interface 14, a controller 16 (preferably a programmable logic controller (PLC)), a predetermined voltage reference (not shown); and a generator field is. The operator interface 14 includes inputs, e.g., switches, buttons, and outputs, e.g., lights, displays, speakers; to enable personnel operation of the lifting device. A second circuit 20—output circuit—is operatively coupled to the generator field 18 and includes a generator armature 22 operatively coupled to an electromagnet 26. The generator armature 22 includes a voltage output 24 operatively coupled to the programmable logic controller 16 of the regulation circuit 12. The coupling between the first 12 and second 20 circuits can be through any means known to one of ordinary skill in the field of electrical circuitry, e.g., wired, wireless; such that the coupling between the circuits—as well as any operatively coupled components described herein—is efficacious; that is, it produces the appropriate or designed effect. A pair of voltage control signals—drop and lift—emanate from the controller 16 and are transmitted to the generator field 18. Transmission of the voltage control signals from the controller 16 to the generator 18 effectively alternates the polarity and reduces the magnitude of the magnetizing force of the electromagnet 26. That is, the drop control signal transmitted from the controller 16 to the generator field 18 results in alternating the polarity and reducing the magnitude of the voltage at the electromagnet 26. Thereafter, transmission of the lift control signal from the controller 16 to the generator field 18 of the generator's armature 22 results in alternating the polarity and further reducing the magnitude of the voltage at the electromagnet 26.

The voltage control drop signal is transmitted from the controller 16 in response to a release material signal being received from the operator interface 14. Transmission of the voltage control drop signal terminates when the armature voltage output 24 is substantially equivalent to the predetermined voltage reference. The voltage control lift signal is transmitted from the controller 16 to the generator field 18 upon termination of the control drop signal, wherein transmission of the control lift signal terminates when the magnitude of the armature voltage output 24 is substantially equivalent to a forward thrust set-point voltage. The forward thrust set-point voltage is dependent upon the predetermined voltage reference and the amount of time taken for the voltage at the electromagnet 26 to drop to the level of the predetermined voltage reference.

That is, the duration of the lift control signal is determined at least partially in response to the duration of the control drop signal—which is ultimately dependent upon the operating characteristics of the electromagnet. Such a method and configuration that is able to account for the operating parameters of the electromagnet 26 will work without the magnet being operatively attached to the system, e.g., generator armature circuit.

Figure 3:
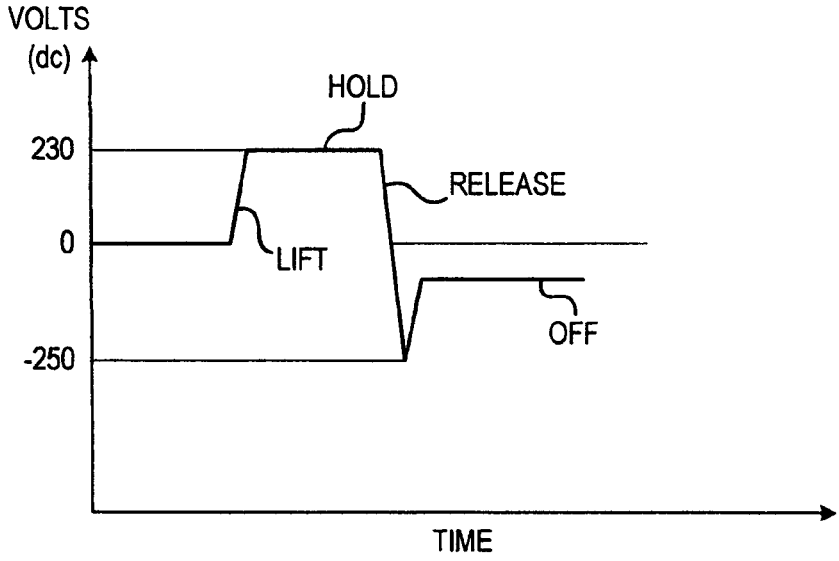
FIG. 3 PRIOR ART
FIG. 3 is a graphic illustration depicting voltage values of a prior art electromagnet during the lift and drop modes.

FIG. 3 is a graphic illustration depicting a voltage of a prior art lifting magnet during the lift and release—or drop—of a magnetic material. Initially, the voltage output of the electromagnet is increased to 230 V(dc) and then remains constant until the polarity of the voltage output from a generator is reversed, which causes the voltage level to drop to approximately −250 V(dec). When the generator is turned off, its voltage output eventually approaches 0 V.

Figure 4:
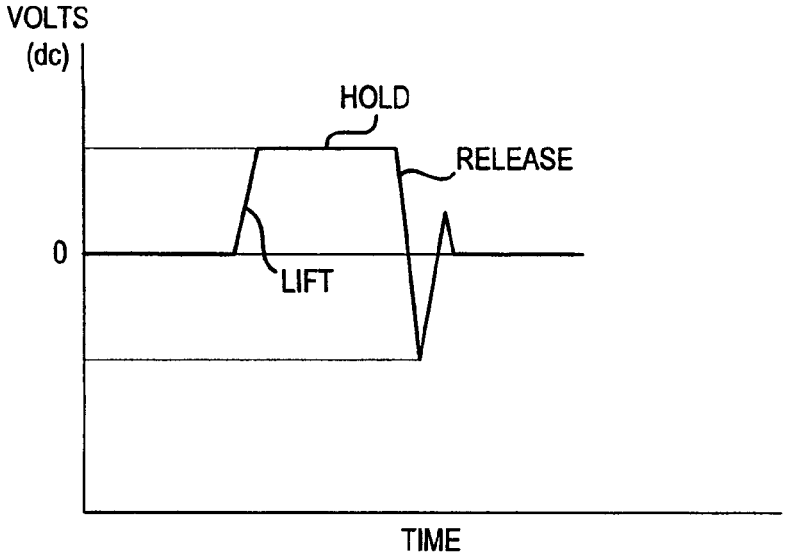
FIG. 4 is a graphic illustration depicting the voltage values of an electromagnet utilized in one embodiment of the present invention during the lift and drop modes; and, FIG. 5 is a flow chart of a method of one embodiment of the present invention for controlling an electromagnet during the release of magnetic material.

In contrast, FIG. 4 is a graphic illustration depicting a voltage at the electromagnet 12 of one embodiment of the present invention during the lift and release of the magnetic material. The initial voltage output of the electromagnet 12 is increased to 230 V(dc) and then remains constant until the first control signal—drop—is transmitted from the controller, whereupon the polarity of the electromagnet voltage is effectively reversed and its magnitude is reduced. Thereafter, the second control signal—lift—is transmitted from the controller 22 to again effectively reverse the polarity and reduce the magnitude of the electromagnet's voltage output. It is to be understood that additional control signals can further be transmitted to continue reversing the polarity and reducing the magnitude of the electromagnet's voltage.

The operating sequence for lifting the magnetic material includes the operator actuating the lift via the interface control panel 14 wherein the controller 16 receives a command to initiate lifting and the controller transmits 24 V(dc) to the generator field 18 to enable the lift relay(s) (L) thereby generating approximately 230 V(dc) from the generator armature output 24.

To drop the magnetic material from the electromagnet 26, the operator initiates the release sequence by actuating the appropriate input on the interface control panel 14 wherein the programmable logic controller 16 enables the drop relay(s) (D) by transmitting the first control signal—drop, −24 V(dc)—to the generator field 18. At this time, the programmable logic controller 16 monitors the voltage output 24 of the armature 22 in the output circuit 20. The controller 16 terminates the first control signal and disables the drop relay(s) (D) in the generator field 18 when the voltage output 24 of the armature 22 is substantially equal to the predetermined voltage reference. It is at this time that the large pieces of magnetic material will fall from the electromagnet 12.

Determination of the predetermined voltage reference for dropping the large pieces of magnetic material from the electromagnet is an empirical process wherein the operator adjusts the voltage of the electromagnet with respect to the lifting and dropping of magnetic materials. Generally, the predetermined voltage reference value is selected when the largest sample-piece of magnetic material to be moved will drop from the electromagnet 26. The predetermined voltage reference is empirically determined by the operator and is generally set to be at the analog voltage level of the electromagnet 26 in relation to the largest piece of magnetic material desired to be lifted, moved, and dropped.

The controller 16 then transmits a second control signal—lift, 24 V(dc)—to the generator field 18 to enable the lift relay(s) (L). In response to a calculated forward thrust set-point voltage, the controller 16 will disable the lift relay(s) (L) and the smaller pieces of magnetic material that did not previously fall from the electromagnet 26 will now fall away. Thereafter, the controller 16 will disable the drop relay(s) (D) at 0 V, or neutral, in the regulation circuit 12.

Calculation of the forward thrust set-point voltage involves consideration of the generator's capacity, operating speed range (drop with load, unwind without load stability), and electromagnet capacity; and is ascertained—at least in part—in response to the amount of time it took for the generator's armature voltage output 24 to reach the predetermined voltage reference after the drop control signal was transmitted from the controller 16 to the generator field 18.

For example, allowing:

X to represent the generator output voltage (e.g., −2.5 V(dc) through 2.5 V(dc)) incrementally represented from 0-4096, e.g., digitally;

Y to represent the predetermined analog voltage reference (0 V(dc) through 5 V(dc)) incrementally represented from 0-4096;

Z to represent the generator drop voltage, e.g., −X;

T to represent the amount of time for the electromagnet to reach the predetermined voltage reference, incrementally represented from 0-99999; and, F to represent the forward thrust set-point voltage.

Further assuming the operator to have determined an analog voltage reference for Y to be 2000; this would equate to 122 V(dc)—which is computed by dividing the electromagnet's voltage range, i.e., 250 V(dc), by the number of increments in the interface input knob, i.e., 4096, to determine the amount of voltage per increment, i.e., 0.061 V. Thus, 250 V(dc)/(4096×2000)=122 V(dc). It is at this point that the largest magnetic materials will drop away from the electromagnet.

The controller 16 also monitors the duration of the first voltage control—drop—signal. That is, the controller 16 measures the amount of time elapsed from when transmission of the drop control signal was initiated to the time it took for die generator's armature output voltage 24 to reach the level of the predetermined analog reference voltage—e.g., 122 V(dc) in the above example. This time duration is then utilized to calculate the forward thrust: set-point voltage. That is, the product of the analog reference voltage, the time duration of the drop signal, and the voltage/increment—i.e., (Y)×(T)×(voltage/increment)—yields the forward thrust set-point voltage. In this example, assuming the amount of elapsed time is 1.3 seconds, the calculated forward thrust set-point voltage is 2000×1.3×0.61, which yields 15.8 V(dc). Thus, when the generator armature voltage 20 reaches substantially 15.8 V(dc), transmission of the second voltage control signal—lift—is terminated. It is at this point that the remaining magnetic material will drop away from the electromagnet.

While it has been observed that utilizing a second voltage control signal at least partially dependent upon aspects—i.e., signal duration—of the first voltage control signal achieves a desirable result, it is to be understood that additional voltage control signals—drop and/or lift—can also be transmitted to the generator field 18. The corresponding additional thrust set-point voltages can be calculated similarly to that of the forward thrust set-point voltage. For instance, the duration of the previous voltage control signal—drop or lift—is utilized with the predetermined analog voltage reference and the voltage per increment.

Additionally, a scaling factor dependent upon the type of load bias applicable to the system, e.g., scrap or deep draw magnets, can also be incorporated into the calculation of the forward thrust set-point voltage, e.g., a percentage of the predetermined voltage reference, Y, can be utilized. Utilizing a 10% scaling factor in the above described example, the calculated forward thrust set-point voltage would be 1.58 V(dc).

Generally, the present invention utilizes voltage output of a generator to demagnetize the electromagnet to more effectively release magnetic materials and reduce the amount of residual magnetism remaining on the released magnetic materials. A plurality of voltage control signals are transmitted from the controller to alternate the polarity and reduce the magnitude of the magnetizing force of the electromagnet. The voltage output of the generator's armature is sensed and compared to a predetermined value, wherein a subsequently transmitted voltage control signal is transmitted in response—at least partially—to the comparison of the sensed output voltage of the generator's armature and the predetermined voltage reference. That is, the polarity and magnitude of the voltage output of the armature will be monitored and its magnitude will be successively decreased and its polarity will be successively reversed in incremental steps to effectively reduce the magnitude of the electromagnet's—and the magnetic material's—residual magnetism to a desirable level.

Figure 5:
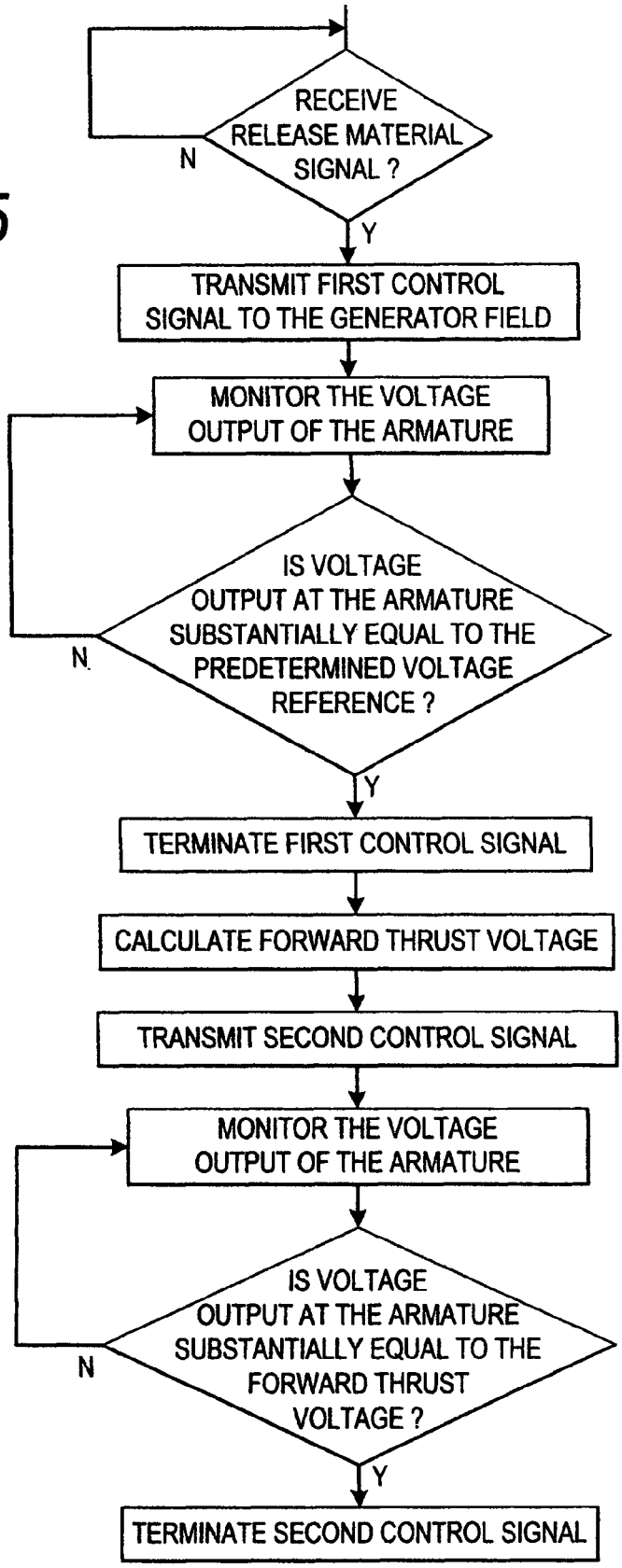

More specifically, the flow chart in FIG. 5 depicts a method for controlling an electromagnet during the release of magnetic material in accordance with one embodiment of the present invention. The release of the magnetic material from the electromagnet is initiated by a release material signal transmitted from the interface control panel 14 being received by the programmable logic controller 16. A first voltage control signal—drop—is transmitted from the programmable logic controller 16 to the generator field 18. The voltage output 24 of the generator armature 22 is monitored and compared against the predetermined analog voltage reference that was determined earlier and previously provided. When the monitored voltage output 24 of the armature 22 is substantially equal to the predetermined analog, voltage reference, transmission of the first voltage control signal is terminated. The duration of the first voltage control signal is utilized to calculate the forward thrust set-point voltage, wherein a second voltage control signal—lift—is transmitted from the programmable logic controller 16 to the generator field 18 until the output voltage 24 of the generator's armature 22 is substantially equal to the calculated forward thrust set-point voltage.

It is to be understood that the present invention may be embodied in other specific forms without departing from the spirit or central characteristics thereof. That is, any type of electrical components known to one of ordinary skill in the field of electrical circuit design that are capable of being utilized to accomplish the objects described herein are contemplated by the present invention. Such electrical components include, and are not limited to, computers, ammeters, volt meters, integrated circuitry, converters, sensors, monitors, comparators, wireless devices, and logic controllers. Furthermore, other embodiments of the present invention include—and are not limited to—utilization with coil lifters wherein more precise control of motor-driven telescoping legs or tongs is facilitated by the present invention described above. The present embodiments, therefore, are to be considered in all respects as illustrative and not restrictive, and the present invention is not to be limited to the details provided herein. Thus, while specific embodiments have been illustrated and described, numerous modification come to mind without significantly departing form the characteristics of the present invention and the scope of protection is only limited by the scope of the accompanying claims.

What is claimed is:

1. A method for controlling a lifting device for moving magnetic material, the lifting device including an electromagnet coupled to a voltage generator, the method comprising the steps of:

providing a predetermined voltage reference to a controller for releasing magnetic material from an electromagnet;

receiving a release material signal from an operator interface;

transmitting a first control signal to the generator;

monitoring the voltage at the generator armature output;

terminating transmission of the first control signal in response to the monitored voltage at the generator armature output being substantially equal to the provided voltage reference;

measuring the length of time elapsed between transmitting and terminating the first control signal;

utilizing the elapsed length of time of the first control signal to calculate a forward thrust set-point voltage;

transmitting a second control signal to the generator; and, terminating transmission of the second control signal in response to the monitored voltage at the generator armature output being substantially equal to the forward thrust set-point voltage.

2. The method of claim 1, further comprising:

measuring the length of time elapsed between transmitting and terminating the second control signal;

utilizing the elapsed length of time of the second control signal to calculate a rearward thrust set-point voltage;

transmitting a third control signal to the generator; and, terminating transmission of the third control signal in response to the monitored voltage at the generator armature output being substantially equal to the rearward thrust set-point voltage.

3. A system for moving magnetic material, the system including an electromagnet for lifting and dropping the magnetic material, the system comprising:

a first circuit including an operator interface, a programmable logic controller, a predetermined voltage reference, and a generator field;

a second circuit operatively coupled to the first circuit, the first circuit including a generator armature operatively coupled to an electromagnet, the generator armature including a voltage output operatively coupled to the programmable logic controller; and, a plurality of control signals including:

a drop signal transmitted from the controller to the generator field in response to a release material signal received from the operator interface, wherein transmission of the voltage drop signal terminates when the armature voltage output is substantially equivalent to the predetermined voltage reference;

a lift signal transmitted from the controller to the generator field upon termination of the drop signal, wherein transmission of the lift signal terminates when the magnitude of the armature voltage output is substantially equivalent to a forward thrust set-point voltage—the forward thrust set-point voltage is at least partially dependent upon the predetermined voltage reference and the duration of the drop signal.

4. The system of claim 3, further comprising:

a rearward thrust set-point voltage calculated at least in part on the duration of the lift signal and the predetermined voltage reference; and, another drop signal transmitted from the controller's output to the generator's control input, wherein transmission of the another drop signal is terminated when the armature's output voltage is substantially equal to the rearward thrust set-point voltage.

* * * * *

UNITED STATES PATENT AND TRADEMARK OFFICE

CERTIFICATE OF CORRECTION

PATENT NO. : 7,791,856 B2
APPLICATION NO. : 11/766945
DATED : September 7, 2010
INVENTOR(S) : John Samila It is certified that error appears in the above-identified patent and that said Letters Patent is hereby corrected as shown below:

In the Specification:

In column 4, line 11, the word "is" should be replaced by -- 18 --

In the Claims:

In column 8, line 33, at line 8 of claim 3, the word "first" should be replaced by -- second --

Signed and Sealed this
Fifteenth Day of April, 2014

Michelle K. Lee

Michelle K. Lee
*Deputy Director of the United States Patent and Trademark Office*